US009035840B1

(12) United States Patent
Lee

(10) Patent No.: US 9,035,840 B1
(45) Date of Patent: May 19, 2015

(54) DUAL-BAND ANTENNA WITH GROUNDED PATCH AND COUPLED FEED

(75) Inventor: Tzung-I Lee, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 192 days.

(21) Appl. No.: 13/419,634

(22) Filed: Mar. 14, 2012

(51) Int. Cl.
*H01Q 13/10* (2006.01)
*H01Q 9/04* (2006.01)
*H01Q 5/01* (2006.01)

(52) U.S. Cl.
CPC ..... *H01Q 13/10* (2013.01); *H01Q 9/0471* (2013.01)

(58) Field of Classification Search
CPC ..... H01Q 1/38; H01Q 1/243; H01Q 9/0407; H01Q 13/10; H01Q 9/0471
USPC ..... 343/700 MS, 702, 770
See application file for complete search history.

(56) References Cited

U.S. PATENT DOCUMENTS 5,229,777 A * 7/1993 Doyle ..... 343/700 MS
6,400,322 B2 * 6/2002 Fang et al. ..... 343/700 MS
6,404,395 B1 * 6/2002 Masuda ..... 343/702
7,256,741 B2 * 8/2007 Wen et al. ..... 343/700 MS
7,427,957 B2 * 9/2008 Zeinolabedin Rafi et al. ..... 343/700 MS
2002/0101381 A1 * 8/2002 Segerstedt ..... 343/702
2003/0076268 A1 * 4/2003 Tarvas et al. ..... 343/702
2005/0146475 A1 * 7/2005 Bettner et al. ..... 343/767
2006/0061512 A1 * 3/2006 Asano et al. ..... 343/702

OTHER PUBLICATIONS

The A.R.R.L. Antenna Book, American Radio Relay League, 1988, pp. 2-24 to 2-25.*

* cited by examiner

*Primary Examiner* — Robert Karacsony
*Assistant Examiner* — Daniel J Munoz
(74) *Attorney, Agent, or Firm* — Lowenstein Sandler LLP

(57) ABSTRACT

Methods and systems for radiating electromagnetic energy with a patch antenna structure are described. The patch antenna structure may be formed of a metal member of the user device and is coupled to a ground plane in a first plane and is coupled to a radio frequency (RF) feed) at a portion of the patch antenna structure disposed in a second plane. The patch antenna structure is configured to radiate at an opening between the patch antenna and the ground plane.

22 Claims, 7 Drawing Sheets

DUAL-BAND ANTENNA WITH GROUNDED PATCH AND COUPLED FEED

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas. Various types of antennas can be used in user devices.

A patch antenna is a type of radio antenna with a low profile, which can be mounted on a flat surface. It consists of a flat rectangular sheet or "patch" of metal, mounted over a larger sheet of metal called a ground plane. Patch antennas are simple to fabricate and easy to modify and customize. Typical patch antennas have two metal sheets that together form a resonant piece of transmission line with a length. The radiation mechanism arises from discontinuities at each truncated edge of the patch antenna.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Figure 1:
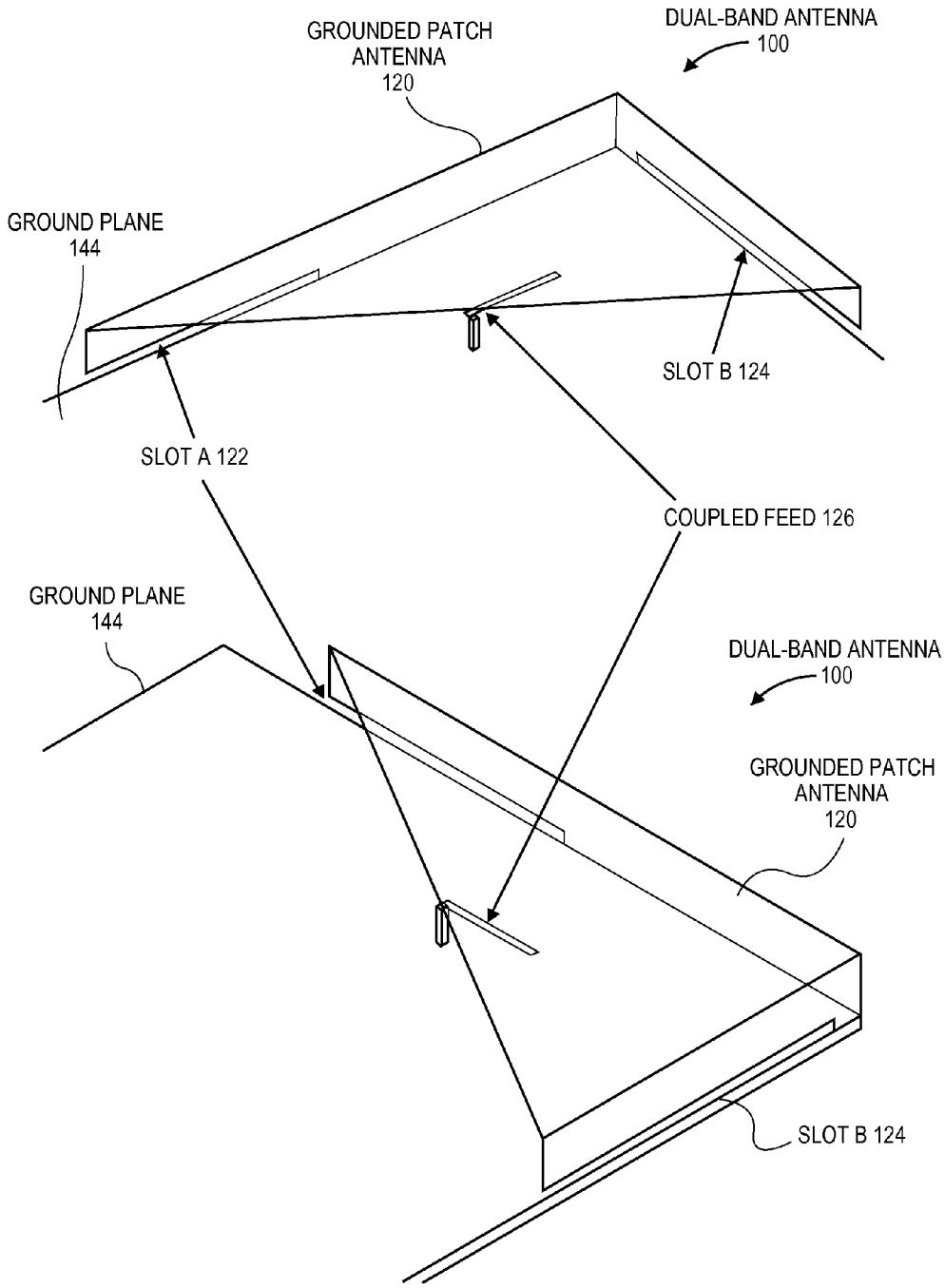
FIG. 1 illustrates perspective views of a dual-band antenna including a grounded patch antenna according to one embodiment.

Methods and systems for radiating electromagnetic energy with a patch antenna structure are described. The patch antenna structure may be formed of a metal member of the user device, is coupled to a ground plane in a first plane, and is coupled to a radio frequency (RF) feed at a portion of the patch antenna structure that is disposed in a second plane. The patch antenna structure is configured to radiate at an opening between the patch antenna and the ground plane. In one embodiment, the patch antenna can be configured to operate as a dual-band antenna for Wi-Fi and GPS applications. In one embodiment, the patch antenna is a grounded patch antenna configured to operate as a dual-band antenna radiator, and includes a coupled feed, a first slot radiator, and a second slot radiator. The grounded patch antenna may be a structural member of the user device. Alternatively, the grounded patch antenna may be a non-structural member of the user device. The slot radiators are formed as slot openings in the structural or non-structural members. For example, the structural member may be a metallic support member that supports a display of the user device, a circuit board, or a user input device of the user device. The structural member may also be a metallic housing of the user device, a metal portion of a non-metallic housing of the user device, a metallic bezel, or the like. The structural or non-structural member may be metal, metal alloy, or the like.

In one embodiment, the grounded patch antenna includes a first side in which the coupled feed is disposed. This side may be disposed on a backside or a front side of the user device. The grounded patch antenna may also include a second side, such as on a top side or a side of the user device, and a third side, such as on the side or the top side of the user device. The first slot radiator can be formed in the second side, and the second slot radiator can be formed in the third side. The grounded patch antenna may be a three-dimensional (3D) structure. In one embodiment, the 3D structure includes a first side having a triangular shape disposed on a front side or a back side of the user device. This triangular shape may be disposed at one of the corners of the user device. The 3D structure also includes a second side and a third side, each having a rectangular shape in which a slot radiator is formed, respectively. In one embodiment, the grounded patch antenna has a polygon shape, such as a triangular shape. For example, a triangle shape patch antenna can formed in a metallic member in one of the corners of the user device. In another embodiment, the grounded patch antenna has an organic shape. Organic shapes are those with a natural look and a flowing or curving appearance. Alternatively, the grounded patch antenna may be a two-dimensional (2D) structure. Also, the grounded patch antenna may have other shapes as would be appreciated by one of ordinary skill in the art having the benefit of this disclosure.

The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

FIG. 1 illustrates one embodiment of a dual-band antenna 100 including a grounded patch antenna 120. As described herein, the grounded patch antenna may have a polygon shape that is formed in a metal member of a user device. In the depicted embodiment, the grounded patch antenna 120 has a triangular shape and is disposed in a corner of the user device above a ground plane 144. The ground plane 144 may be a metal frame of the user device. The ground plane 144 may be a system ground or one of multiple grounds of the user device. It should be noted in other embodiments, the grounded patch antenna 120 can be disposed below the ground plane 144, as well as in other orientations relative to the ground plane 144. In other embodiments, the ground plane 144 may be a printed circuit board (PCB).

In this embodiment, the dual-band antenna 100 is fed at a coupled feed 126 disposed on the grounded patch antenna 120. The coupled feed 126 may be a feed line connector that couples the dual-band antenna 100 to a feed line (also referred to as the transmission line), which is a physical connection that carriers the RF signal to and/or from the dual-band antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to grounded patch antenna 110 via the coupled feed 126. It should also be noted that the grounded patch antenna 120 is also coupled to the ground plane as described herein.

In the depicted embodiment, the coupled feed 126 is disposed at a first edge of one of the sides of the triangular shape. More specifically, the coupled feed 126 is disposed at a center of the side that is opposite to the corner of the user device; although other locations for the coupled feed 126 are possible. A ground plane 144 is disposed in a first plane of the user device. The grounded patch antenna 120 is coupled to the ground plane in the first plane. In the depicted embodiment, the grounded patch antenna 120 has two sides that are connected to the ground plane 140, and includes two slot radiators 122 and 124, one slot radiator on each side. A slot opening A 122 is formed in the metal of the first side, and a second slot opening B 124 is formed in the metal of the second side. A third side of the grounded patch antenna 120 is a triangular shape disposed in the second plane. The triangular shape is coupled to the two sides, and portions of the two sides are coupled to the ground plane 144. The coupled feed 126 is coupled to a feed location of the grounded patch antenna 120. In the depicted embodiment, the coupled feed 126 has a coupling length that extends from a point of the feed location and towards the side that includes the slot opening B 124. Also, the feed location is located at center point on an edge that is opposite the corner of the user device. In other embodiments, the feed location may be located at other positions on the grounded patch antenna 120 and the coupled feed 126 may be disposed in other configurations as would be appreciated by one of ordinary skill in the art having the benefit of this disclosure.

In the depicted embodiment, the slots openings A and B are formed at the bottom of the two sides. In other embodiments, the locations of the slot openings may be varied. Also, in the depicted embodiment, the remaining portion of metal at the bottom is coupled to the ground plane 144. In one embodiment, a portion of metal near the bottom of the side with the slot opening B 124 is smaller than the portion of metal near the bottom of the side with the slot opening A 122, but these portions may be changed based on the needed dimensions of the slot openings A 122 and B 124. A slot radiator consists of a metal surface, usually a flat plate, with a hole or slot cut out or opening. When the plate is driven as an antenna by a driving frequency, the slot opening radiates electromagnetic waves in similar way to a dipole antenna. The shape and size of the slot opening, as well as the driving frequency, determine the radiation distribution pattern. A slot radiator's main advantages are its size, design simplicity, robustness, and convenient adaptation to mass production.

In the depicted embodiment, the dual-band antenna 100 is configured to radiate at an opening between the grounded patch antenna 120 and the ground plane 140. The grounded patch antenna 120 is configured to operate as a dual-band antenna radiator with the coupled feed 126 and the first and second slot opening 122 and 124. The grounded patch antenna 120 is formed of a metal member of the user device. This metal member may be structural or non-structural, such as a metal member that is used for decorative or aesthetic purposes. The feed location, a coupling length of the RF coupling feed 126, and dimensions of the first slot opening 122 and dimensions of a second slot opening 124 contribute to resonant frequencies of the patch antenna structure 120. In one embodiment, the first slot opening 122 (also referred to the first slot radiator) is configured to create a first frequency band and the second slot opening 124 (also referred to the second slot radiator) is configured to create a second frequency. In one embodiment, the first frequency band is a 1.575 GHz frequency band and the second frequency band is 5 GHz frequency band. In another embodiment, the first frequency band is a 2.45 GHz frequency band and the second frequency band is 5 GHz frequency band. Alternatively, other frequency bands may be achieved by changing the feed location, the coupling length, the dimensions of the slot openings, as well as other dimensions of the dual-band antenna 100. In another embodiment, the ground patch antenna 120 is configured to provide a first resonant mode, such as in a Wi-Fi frequency band, and a second resonant mode, such as in a Global Positioning System (GPS) frequency band. Alternatively, the grounded patch antenna 120 can be configured to provide more or less resonant modes and may be in other frequency ranges as would be appreciated by one of ordinary skill in the art having the benefit of this disclosure.

In one embodiment, the grounded patch antenna 120 is formed in a metal member of the user device. The metal member may be a structural member of the user device, and the first slot radiator is formed as a first slot opening in the metal on one of the sides of the grounded patch antenna 120, and the second slot radiator is formed as a second slot opening in the metal on one of the other sides of the ground patch antenna 120. The structural member may be a metallic support member that supports a display of the user device, a circuit board of the user device, a metal back panel of an assembly that supports the circuit board, a metallic housing of the user device, a metal portion of a non-metallic housing of the user device, or a metallic bezel of the user device. Alternatively, the structural member may be a metallic support member that supports a user input device, such as a touch screen, touchpad, or touch panel.

In other embodiments, the metal member may be a non-structural member of the user device. For example, the non-structural member may be a metal member that is used for decorative or aesthetic purposes. Alternatively, the metal member may be both structural and decorative.

In some embodiments, the opening between the grounded patch antenna 120 and the ground plane 144 is an air gap. In another embodiment, dielectric material may be disposed between the grounded patch antenna 120 and the ground plane 144. In one embodiment, the grounded patch antenna 120 is disposed on an antenna carrier, such as a dielectric carrier of the user device. The antenna carrier may be any non-conductive material, such as dielectric material, upon which the conductive material of the dual-band antenna 100 can be disposed without making electrical contact with other metal within the user device, except at the portions of the grounded patch antenna 120 that are coupled to the ground plane 144. In another embodiment, portions of the dual-band antenna 100 may be disposed on or within a circuit board, such as a printed circuit board (PCB). Alternatively, the dual-band antenna 100 may be disposed on other components of the user device or within the user device as would be appreciated by one of ordinary skill in the art having the benefit of this disclosure. It should be noted that the dual-band antenna 100 illustrated in FIG. 1 is a planar, three-dimensional (3D) structure. However, as described herein, the dual-band antenna 100 may include 2D structures, as well as other variations than those depicted in FIG. 1.

Figure 2:
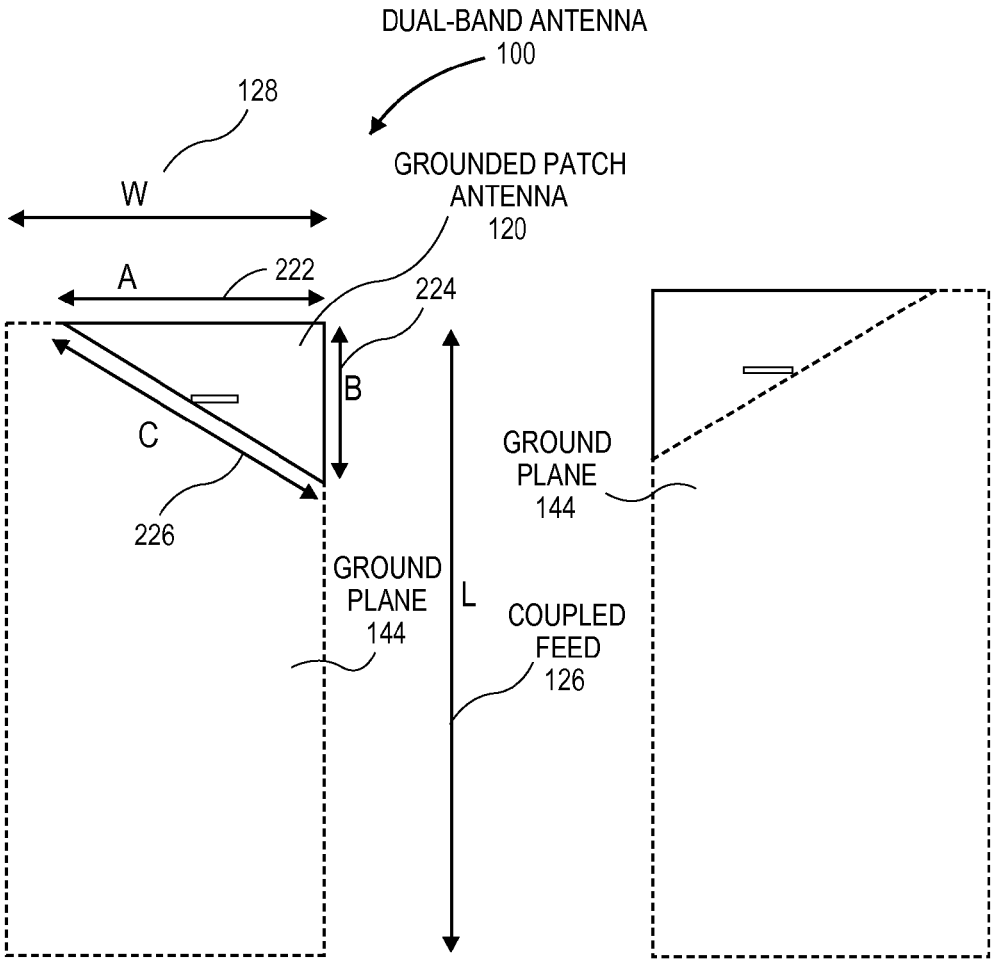
FIG. 2 illustrate a front view and a back view of the dual-band antenna of FIG. 1.

FIG. 2 illustrate a front view and a back view of the dual-band antenna of FIG. 1. The front side view illustrate that the front side of the grounded patch antenna 120 has three sides 222, 224, and 226. The side 226 is the edge where the opening between the grounded patch antenna 120 and the ground plane 144 and the coupled feed 126 are located. triangular. The side 226 has a length C. In one embodiment, the length C is 57 mm. The side 222 is on the top side of the user device. The side 222 has a length A. In one embodiment, the length A is 50 mm. The side 224 is on the side of the user device. The side 224 has a length B. In one embodiment, the length B is 30 mm. Also, in the depicted embodiment, the ground plane 144 has a length L 126 and a width W 128. In one embodiment, the length L is 120 mm and 4 mm.

Figure 3:
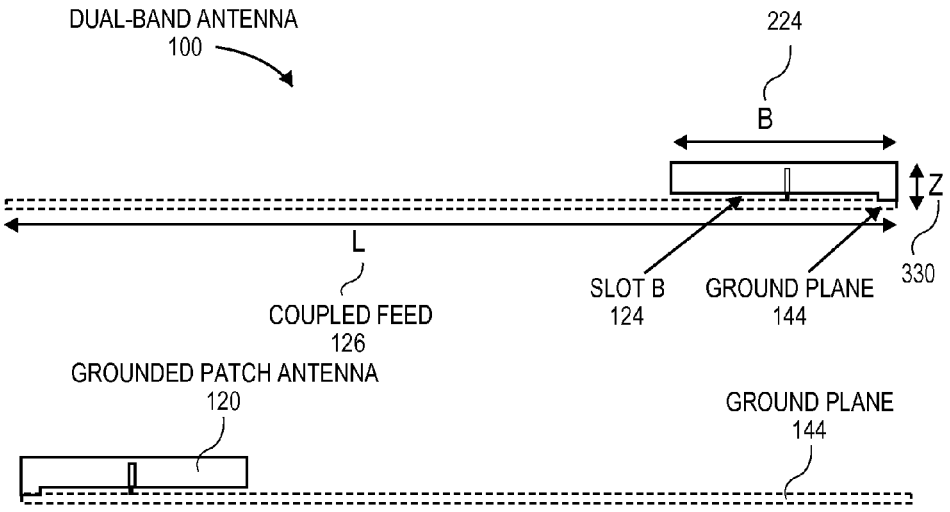
FIG. 3 illustrates side views of the dual-band antenna of FIG. 1.

FIG. 3 illustrates side views of the dual-band antenna 100 of FIG. 1. The grounded patch antenna 120 has a depth (Z) 330. In one embodiment, the depth (Z) 330 is 6 mm. The one side view illustrates the slot opening B 124 and the portion of the one side of metal that is coupled to the ground plane 144. In one embodiment, the slot opening B 124 has a length of 25 mm.

Figure 4:
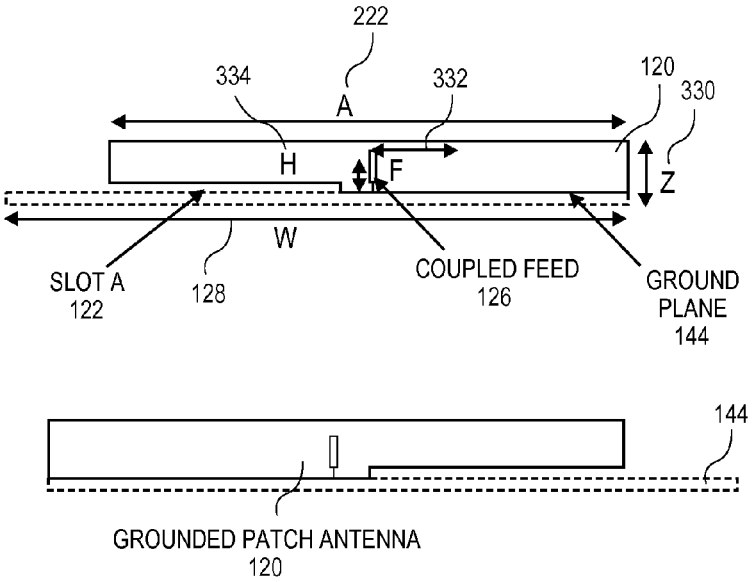
FIG. 4 illustrates a top view and a bottom view of the dual-band antenna of FIG. 1.

FIG. 4 illustrates a top view and a bottom view of the dual-band antenna 100 of FIG. 1. In one embodiment, the one side view shows the slot opening A 122 and the portion of the one side of metal that is coupled to the ground plane 144. In one embodiment, the slot opening A 122 has a length of 26 mm. In one embodiment, the coupled feed 126 has a height (H) 334 and a width (F) 332. In one embodiment, the height (H) 334 is 4 and the width (F) 332 is 10 mm.

Although specific dimensions are described with respect to FIGS. 1-4, other dimensions may be used as would be appreciated by one of ordinary skill in the art having the benefit of this disclosure.

Figure 5:
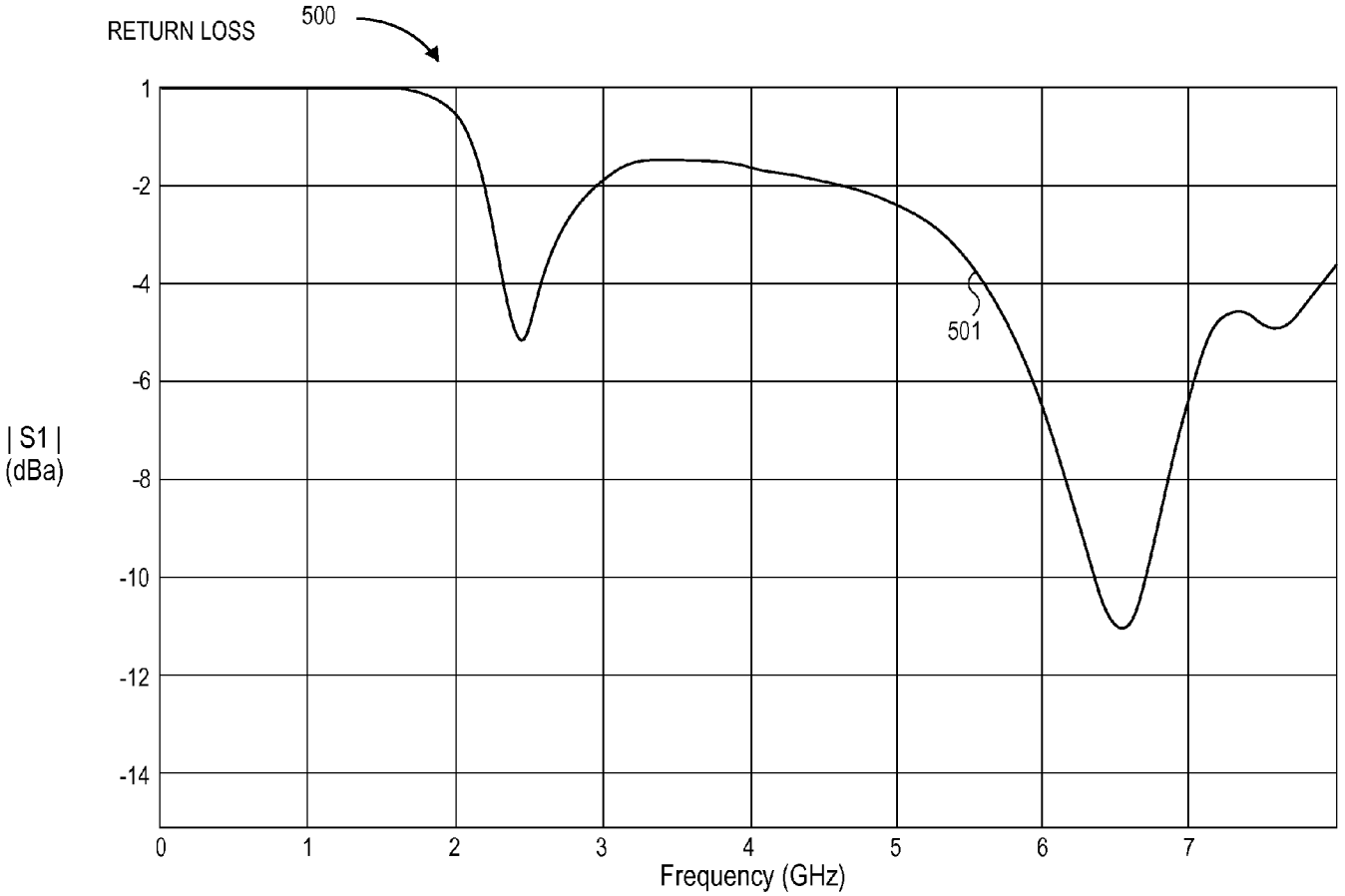
FIG. 5 is a graph of a return loss of the multi-band antenna of FIG. 1 according to one embodiment.

FIG. 5 is a graph of a return loss of the multi-band antenna of FIG. 1 according to one embodiment. The graph 500 shows the measured return loss (|S1|) of the structure of the dual-band antenna 100 of FIG. 1. The dual-band antenna 100 includes multiple resonant modes. In the depicted embodiment, one resonant mode is at the 2.45 GHz frequency band, and the second resonant mode is in the 6.5 GHz frequency band. Alternatively, other resonant modes may be achieved as would be appreciated by one of ordinary skill in the art having the benefit of this disclosure. In one embodiment, the multiple resonant modes may be used for Wi-Fi applications and GPS applications, as described herein. Alternatively, other frequency ranges may be covered for other types of applications. five resonant modes.

Figure 6:
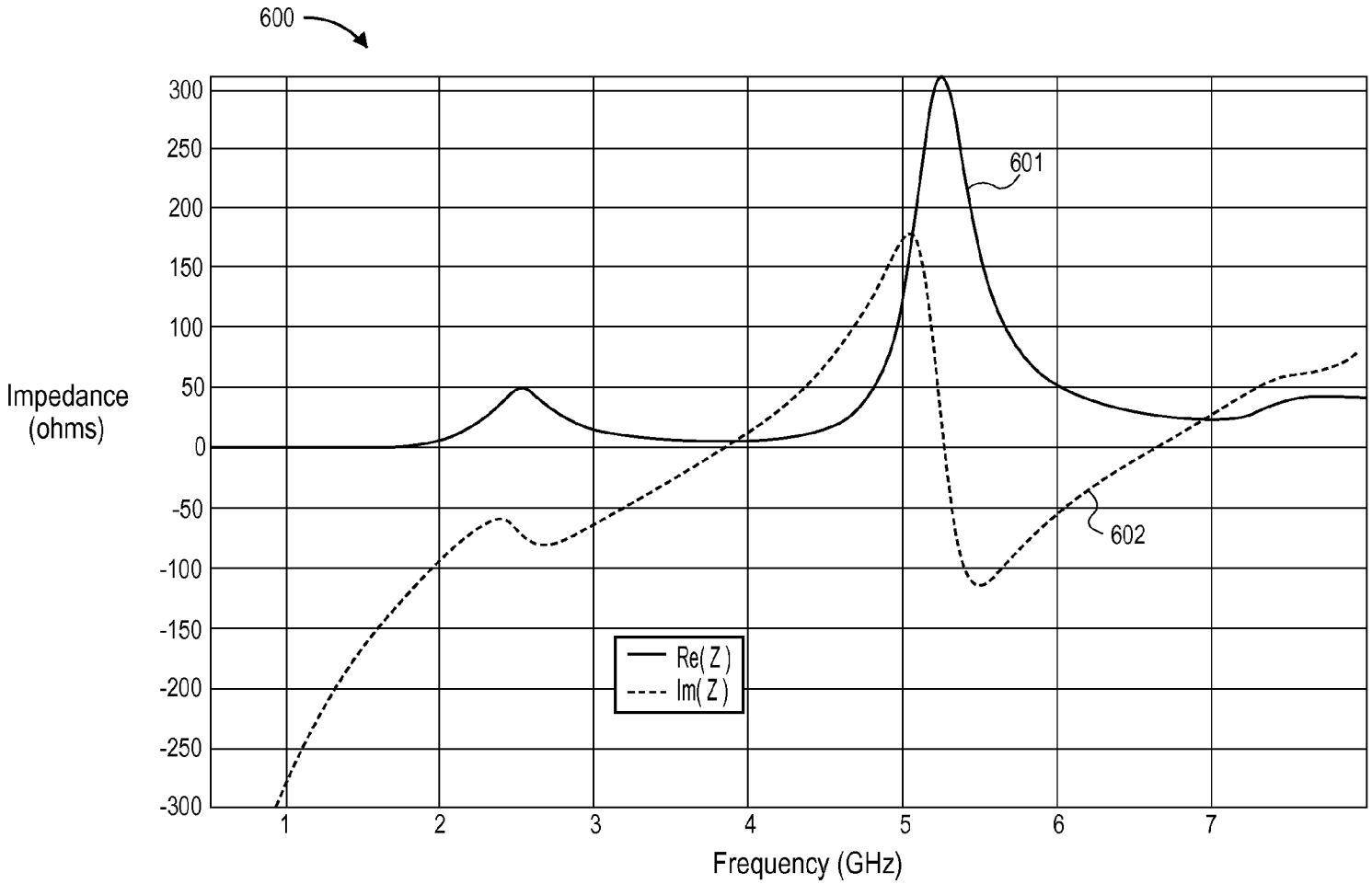
FIG. 6 is a graph of impedance and frequency of the wide-band antenna of FIG. 1 according to one embodiment.

FIG. 6 is a graph of impedance and frequency of the wide-band antenna of FIG. 1 according to one embodiment. The graph 600 illustrates reactance 602 and resistance 601 over a range of frequency of the dual-band antenna 100 including the grounded patch antenna 120. The graph 600 illustrates that the dual-band antenna 100 is a viable antenna for the frequency range between 2 GHz and 7 GHz.

Figure 7:
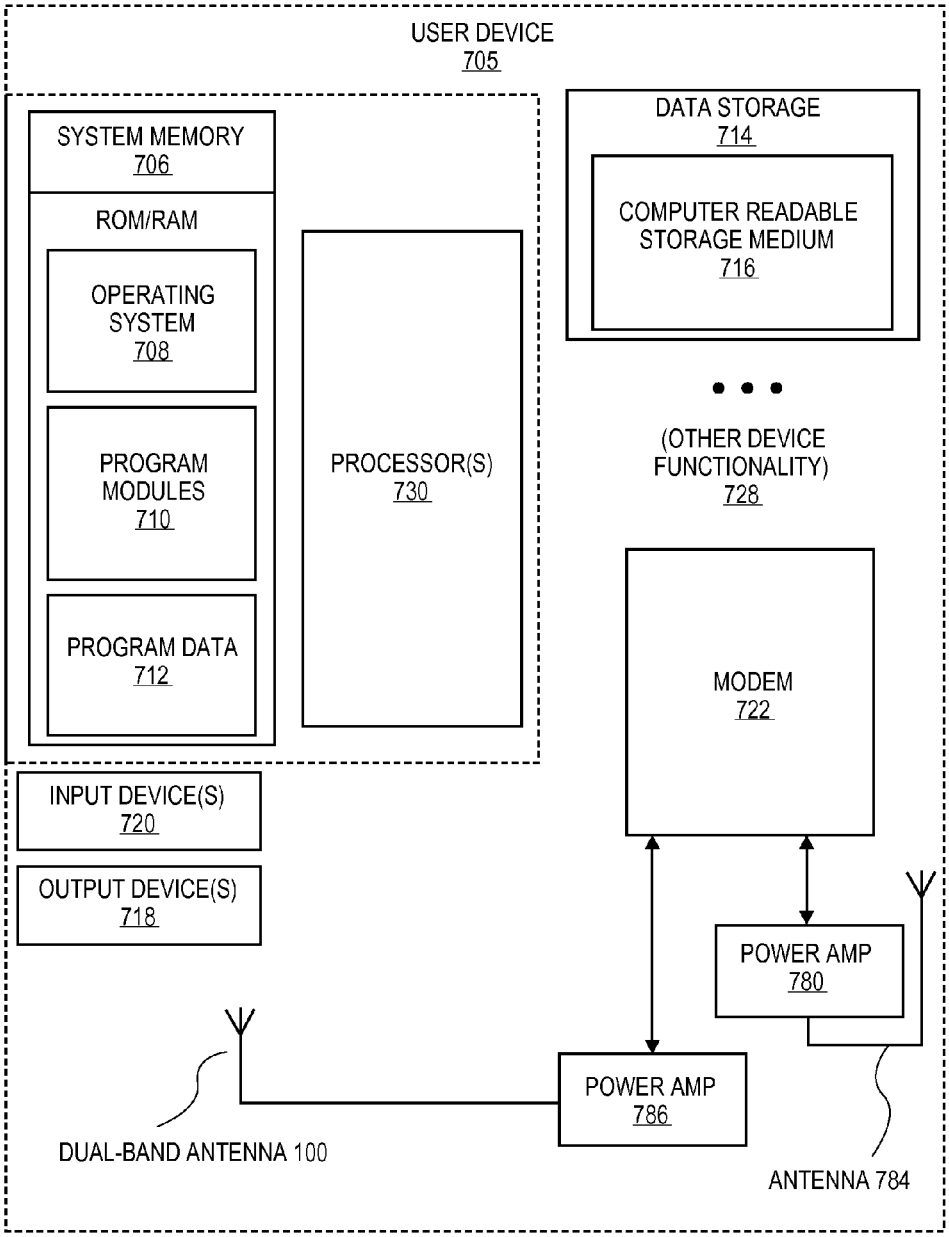
FIG. 7 is a block diagram of a user device having a dual-band antenna according to one embodiment.

FIG. 7 is a block diagram of a user device 705 having the dual-band antenna 100 of FIG. 1 according to one embodiment. The user device 705 includes one or more processors 730, such as one or more CPUs, microcontrollers, field programmable gate arrays, or other types of processing devices. The user device 705 also includes system memory 706, which may correspond to any combination of volatile and/or non-volatile storage mechanisms. The system memory 706 stores information which provides an operating system component 708, various program modules 710, program data 712, and/or other components. The user device 705 performs functions by using the processor(s) 730 to execute instructions provided by the system memory 706.

The user device 705 also includes a data storage device 714 that may be composed of one or more types of removable storage and/or one or more types of non-removable storage. The data storage device 714 includes a computer-readable storage medium 716 on which is stored one or more sets of instructions embodying any one or more of the functions of the user device 705, as described herein. As shown, instructions may reside, completely or at least partially, within the computer readable storage medium 716, system memory 706 and/or within the processor(s) 730 during execution thereof by the user device 705, the system memory 706 and the processor(s) 730 also constituting computer-readable media. The user device 705 may also include one or more input devices 720 (keyboard, mouse device, specialized selection keys, etc.) and one or more output devices 718 (displays, printers, audio output mechanisms, etc.).

The user device 705 further includes a wireless modem 722 to allow the user device 705 to communicate via a wireless network (e.g., such as provided by a wireless communication system) with other computing devices, such as remote computers, an item providing system, and so forth. The wireless modem 722 allows the user device 705 to handle both voice and non-voice communications (such as communications for text messages, multimedia messages, media downloads, web browsing, etc.) with a wireless communication system. The wireless modem 722 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WiFi, etc. In other embodiments, the wireless modem 722 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 705 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 705 to communicate with other devices, such as other user devices, server computing systems, telephone devices, or the like. In addition to wirelessly connecting to a wireless communication system, the user device 705 may also wirelessly connect with other user devices. For example, user device 705 may form a wireless ad hoc (peer-to-peer) network with another user device.

The wireless modem 722 may generate signals and send these signals to power amplifier (amp) 780 or power amp 786 for amplification, after which they are wirelessly transmitted via the dual-band antenna 100 or antenna 784, respectively. Although FIG. 7 illustrates power amps 780 and 786, in other embodiments, a transceiver may be used to all the antennas 110 and 784 to transmit and receive. The antenna 784, which is an optional antenna that is separate from the dual-band antenna 100, may be any directional, omnidirectional, or non-directional antenna in a different frequency band than the frequency bands of the dual-band antenna 100. The antenna 784 may also transmit information using different wireless communication protocols than the dual-band antenna 100. In addition to sending data, the dual-band antenna 100 and the antenna 784 also receive data, which is sent to wireless modem 722 and transferred to processor(s) 730. It should be noted that, in other embodiments, the user device 705 may include more or less components as illustrated in the block diagram of FIG. 7.

In one embodiment, the user device 705 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the dual-band antenna 100 that operates at a first frequency band and the second wireless connection is associated with a second resonant mode of the dual-band antenna 100 that operates at a second frequency band. In another embodiment, the first wireless connection is associated with the dual-band antenna 100 and the second wireless connection is associated with the antenna 784. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 722 is shown to control transmission to both antennas 110 and 784, the user device 705 may alternatively include multiple wireless modems, each of which is configured to transmit/receive data via a different antenna and/or wireless transmission protocol. In addition, the user device 705, while illustrated with two antennas 110 and 784, may include more or fewer antennas in various embodiments.

The user device 705 delivers and/or receives items, upgrades, and/or other information via the network. For example, the user device 705 may download or receive items from an item providing system. The item providing system receives various requests, instructions, and other data from the user device 705 via the network. The item providing system may include one or more machines (e.g., one or more server computer systems, routers, gateways, etc.) that have processing and storage capabilities to provide the above functionality. Communication between the item providing system and the user device 705 may be enabled via any communication infrastructure. One example of such an infrastructure includes a combination of a wide area network (WAN) and wireless infrastructure, which allows a user to use the user device 705 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 705.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 705 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 705 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 8:
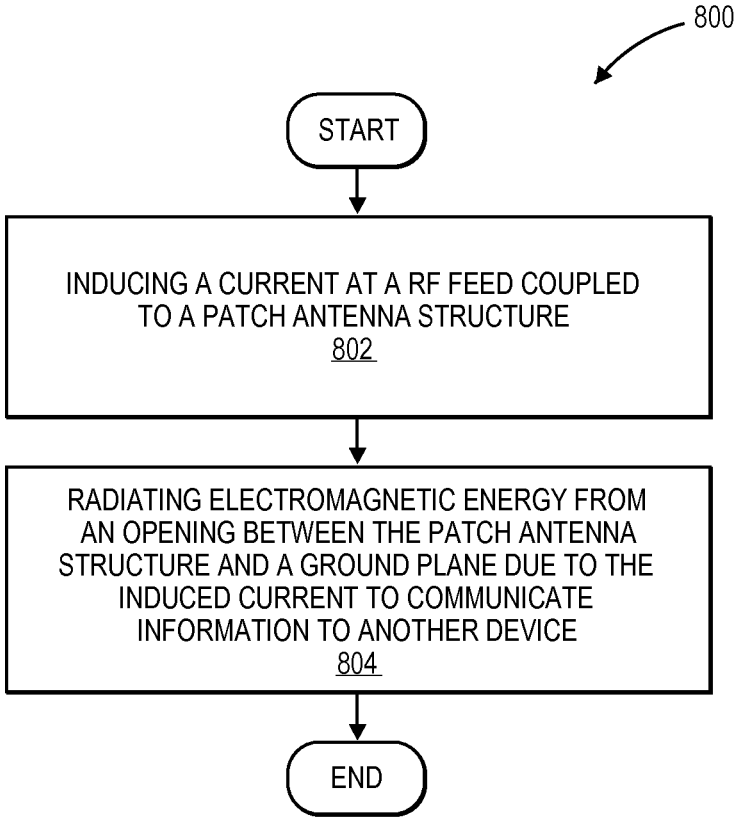
FIG. 8 is a flow diagram of an embodiment of a method of operating a user device having a dual-band antenna according to one embodiment.

FIG. 8 is a flow diagram of an embodiment of a method 800 of operating a user device having a dual-band antenna according to one embodiment. In method 800, a current is induced at an RF feed coupled to a patch antenna structure (e.g., grounded patch antenna 120) to provide multiple resonant modes (block 802). In response, the patch antenna structure radiates electromagnetic energy to communicate information to another device (block 804). The electromagnetic energy forms a radiation pattern. The radiation pattern may be various shapes as would be appreciated by one of ordinary skill in the art having the benefit of this disclosure.

In one embodiment, a current is induced at the RF feed, which induces a surface current flow of the grounded patch antenna. The slot openings and the opening between the grounded patch antenna and the ground plane radiate electromagnetic energy at multiple frequency ranges as described herein.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device comprising:

a single radio frequency (RF) input; and a grounded patch antenna configured to operate as a dual-band antenna radiator, wherein the grounded patch antenna is formed of a metal member of the user device, wherein the metal member is three-dimensional comprising a first surface in a first plane, a second surface in a second plane and a third surface in a third plane, and wherein the grounded patch antenna comprises:

a coupled feed coupled to the single RF input at the first surface, wherein the first surface has a triangular shape, wherein the coupled feed is disposed at an edge of a hypotenuse of the triangular shape, wherein the first surface of the grounded patch antenna is disposed in the first plane parallel to a ground plane, and wherein the second surface extends from the first plane to the ground plane in the second plane perpendicular to the first plane and the third surface extends from the first plane to the ground plane in the third plane perpendicular to the first plane;

a first slot radiator formed in the second surface of the metal member, wherein the second surface is a rectangular shape, wherein the first slot radiator is formed as a first slot opening in the second surface, the first slot opening not extending an entire length of the second surface; and a second slot radiator formed in the third surface of the metal member, wherein the third surface is a rectangular shape, wherein the second slot radiator is formed as a second slot opening in the third surface, the second slot opening not extending an entire length of the third surface.

2. The user device of claim 1, wherein the metal member is a structural member of the user device.

3. The user device of claim 2, wherein the structural member is a metallic support member that at least partially supports a display of the user device.

4. The user device of claim 2, wherein the structural member is a metallic support member that supports a user input device.

5. The user device of claim 2, wherein the structural member is at least one of a metallic support member that supports a circuit board of the user device, a metal back panel of an assembly that supports the circuit board, a metallic housing of the user device, a metal portion of a non-metallic housing of the user device, or a metallic bezel of the user device.

6. The user device of claim 1, wherein the metal member is a non-structural member of the user device, wherein the non-structural member comprises metal that is not used to support a structure of the user device.

7. The user device of claim 1, wherein the first slot radiator is formed at a bottom of the second surface closer to the ground plane, and wherein the second slot radiator is formed at a bottom of the third surface closer to the ground plane.

8. The user device of claim 1, wherein the first slot radiator is configured to cover a first frequency band and the second slot radiator is configured to cover a second frequency band.

9. The user device of claim 8, wherein the first frequency band is a 1.575 GHz frequency band and the second frequency band is a 5 GHz frequency band.

10. The user device of claim 8, wherein the first frequency is a 2.45 GHz frequency band and the second frequency is a 5 GHz frequency band.

11. The user device of claim 1, wherein the grounded patch antenna is configured to provide a first resonant mode and a second resonant mode.

12. The user device of claim 11, wherein the first resonant mode is in a Wi-Fi frequency band and the second resonant mode is in a Global Positioning System (GPS) frequency band.

13. An apparatus comprising:

a radio frequency (RF) feed;

a ground plane disposed in a first plane; and a patch antenna structure formed of a metal member of a user device, wherein the patch antenna structure is coupled to the ground plane, wherein the RF feed is coupled to a first portion of the patch antenna structure, the first portion being disposed in a second plane parallel to the first plane, and wherein the patch antenna structure is configured to radiate at an opening between the patch antenna and the ground plane, wherein the first portion has a triangular shape and the RF feed is coupled to a feed location at an edge of a hypotenuse of the triangular shape of the first portion, and wherein the patch antenna structure comprises:

the first portion;

a second portion disposed between a first side of the first portion and the ground plane in a third plane perpendicular to the second plane, wherein the second portion comprises a first slot opening; and a third portion disposed between a second side of the first portion and the ground plane in a fourth plane perpendicular to the second plane, wherein the third portion comprises a second slot opening.

14. The apparatus of claim 13, wherein the feed location, a coupling length of the RF feed, and dimensions of the first slot opening and dimensions of a second slot opening contribute to resonant frequencies of the patch antenna structure.

15. A user device comprising:

a wireless modem;

a ground plane disposed in a first plane of the user device; and a dual-band antenna configured to radiate electromagnetic energy to communicate data to and from the wireless modem via a radio frequency (RF) feed coupled to the wireless modem, wherein the dual-band antenna comprises a patch antenna structure formed of a metal member of the user device, wherein the patch antenna structure is coupled to the ground plane on two faces of a three-dimensional triangular shape with a first opening at a hypotenuse of the three-dimensional triangular shape, wherein the RF feed is coupled to a first portion of the patch antenna structure at an edge of the hypotenuse, the first portion being disposed in a second plane parallel to the first plane to form a third face of the three-dimensional triangular shape, and wherein the patch antenna structure is configured to radiate at the first opening between the patch antenna and the ground plane in a fourth face of the three-dimensional triangular shape, wherein the patch antenna structure comprises:

the first portion;

a second portion disposed between a first side of the first portion and the ground plane in a third plane perpendicular to the second plane to form a first face of the two faces of the three-dimensional triangular shape, wherein the second portion comprises a first slot opening; and a third portion disposed between a second side of the first portion and the ground plane in a fourth plane perpendicular to the second plane to form a second face of the two faces of the three-dimensional triangular shape, wherein the third portion comprises a second slot opening.

16. The user device of claim 15, further comprising a transceiver coupled to the wireless modem and the RF feed.

17. The user device of claim 15, wherein the dual-band antenna is configured to operate in a 1.575 GHz frequency band and a 5 GHz frequency band.

18. The user device of claim 15, wherein the dual-band antenna is configured to operate in a 2.45 GHz frequency band and a 5 GHz frequency band.

19. A method of operating a user device, the method comprising:

inducing a current at a radio frequency (RF) feed coupled a patch antenna structure formed of a metal member of the user device, wherein the patch antenna structure is configured to form a first opening at a first face a three-dimensional triangular shape between a first portion of the patch antenna structure in a first plane and a ground plane disposed in a second plane parallel to the first plane, wherein the patch antenna structure is coupled to the ground plane at a second face and a third face of the three-dimensional triangular shape, wherein the RF feed is coupled to the patch antenna structure at a feed location on a hypotenuse edge of the first face; and radiating electromagnetic energy from the first opening due to the induced current to communicate information to another device, and wherein the patch antenna structure comprises:

the first portion;

a second portion disposed between a first side of the first portion and the ground plane in a third plane perpendicular to the second plane, wherein the second portion comprises a first slot opening; and a third portion disposed between a second side of the first portion and the ground plane in a fourth plane perpendicular to the second plane, wherein the third portion comprises a second slot opening.

20. The method of claim 19, wherein said inducing the current provides a first resonant mode and a second resonant mode.

21. The method of claim 20, wherein the first resonant mode is in a 1.575 GHz frequency band and the second resonant mode is in a 5 GHz frequency band.

22. The method of claim 20, wherein the first resonant mode is in a 2.45 GHz frequency band and the second resonant mode is in a 5 GHz frequency band.

* * * * *